US005381069A

United States Patent [19]

Itoh et al.

[11] Patent Number: 5,381,069

[45] Date of Patent: Jan. 10, 1995

[54] FIELD EMISSION ELEMENT AND PROCESS FOR MANUFACTURING SAME

[75] Inventors: Shigeo Itoh; Teruo Watanabe; Hisashi Nakata; Norio Nishimura, all of Mobara; Junji Itoh; Seigo Kanemaru, both of Tsukuba, all of Japan

[73] Assignees: Futaba Denshi Kogyo K.K., Mobara; Agency of Industrial Science and Technology, Tsukuba, both of Japan

[21] Appl. No.: 159,114

[22] Filed: Nov. 30, 1993

Related U.S. Application Data

[63] Continuation of Ser. No. 766,215, Sep. 27, 1991, abandoned.

[30] Foreign Application Priority Data

Sep. 27, 1990 [JP] Japan ..... 2-255053

[51] Int. Cl.[6] ..... H01J 19/24; H01J 19/02

[52] U.S. Cl. ..... 313/310; 313/309; 313/351

[58] Field of Search ..... 313/309, 310, 336, 351, 313/308

[56] References Cited

U.S. PATENT DOCUMENTS

| | | | |
|---|---|---|---|
| 4,827,177 | 5/1989 | Lee et al. | 313/336 |
| 4,904,895 | 2/1990 | Tsukamoto et al. | 313/351 |
| 5,030,921 | 7/1991 | Kane | 313/309 |
| 5,189,341 | 2/1993 | Itoh et al. | 315/169.1 |
| 5,256,936 | 10/1993 | Itoh et al. | 313/495 |

*Primary Examiner*—Donald J. Yusko
*Assistant Examiner*—N. D. Patel
*Attorney, Agent, or Firm*—Oblon, Spivak, McClelland, Maier & Neustadt

[57] ABSTRACT

A field emission element in which the emitter has rectangular projections at its distal end capable of readily controlling the interval between electrodes in increments as small as sub-microns, in order to reduce the voltage at which the device starts field emission at the required level and to improve emission uniformity. An emitter (2,20), a collector (3,21) and a gate (5,22) are arranged on a substrate (1), which is formed with a recess (4) in proximity to the electrodes (2,3, 20,21) other than the gate (5). The gate (5) is provided in the recess (4).

6 Claims, 7 Drawing Sheets

FIELD EMISSION ELEMENT AND PROCESS FOR MANUFACTURING SAME

This application is a continuation of application Ser. No. 07/766,215, filed on Sep. 27, 1991, now abandoned.

BACKGROUND OF THE INVENTION

1. Field of the Invention

This invention relates to a field emission device or element and process for manufacturing the same, and more particularly to an electron emission element of the field emission type suitable for use as an electron source for various equipment such as a display element, a printer head, a light source, an amplifying element, a high-speed switching element, a sensor and the like and a method for manufacturing the same.

2. Discussion of Background

FIG. 14 shows a conventional electron emission element of the field emission type as disclosed in Japanese Patent Application Laid-Open Publication No. 33833/1989. This field emission element includes an insulating substrate 200 and an emitter 202 on the substrate 200 having a triangular projection 201 with an acute distal end at its central portion. The field emission element also includes a gate 204 which is adjacent the emitter 202 on the substrate 200 and has an opening 203 corresponding to the projection 201. A secondary electron emission electrode 205 is located on the substrate 200 opposite to the emitter 202 with the gate 204 being interposed between them and parallel to the gate 204.

In the conventional field emission element constructed as described above, the application of a predetermined potential between the emitter 202 and the gate 204, as well as between the gate 204 and the secondary electron emission electrode 205, causes electrons to be emitted from the projection 201 of the emitter 202 to pass through the opening 203 of the gate 204 and to impinge on the secondary electron emission electrode 205, resulting in the secondary electron emission electrode 205 emitting secondary electrons.

As described above, in the conventional field emitting element, the emitter 202, gate 204 and secondary electron emission electrode 205 are arranged side by side on the substrate 200. The electrodes are separately formed by means of separately prepared mask patterns. This causes the intervals between the electrodes to be set or determined in dependence upon the exposure resolution in the photolithography processing, the accuracy of the etching, the accuracy of the master patterns, the accuracy of the registration or alignment between the master patterns, and so on.

A reduction in drive voltage for the field emission element is attained by decreasing the interval between the electrodes. Unfortunately, the conventional field emission element fails to practice accurately the photolithography processing for determining the interval between the electrodes. Such a restriction in the manufacturing of the field emission element results in the interval between the electrodes in the conventional field emission device failing to be reduced uniformly with good reproducibility, which leads to a failure to decrease the drive voltage for the field emission element to the required amount.

The present invention has been made in view of the foregoing disadvantage of the prior art.

SUMMARY OF THE INVENTION

Accordingly, it is an object of the present invention to provide a field emission element which is capable of reducing the voltage at which the element starts field emission to the required amount.

It is another object of the present invention to provide a field of emission element which is capable of readily controlling the interval between electrodes in increments as small as sub-microns.

It is a further object of the present invention to provide a field emission element which is capable of improving the frequency characteristics.

It is still another object of the present invention to provide a field emission element which can be manufactured with high accuracy, and good reproducibility readily increased in area and ensuring uniform quantity.

It is yet another object of the present invention to provide a field emission element which is capable of accomplishing uniform field emission and significantly increasing the electron emission area.

It is a still further object of the present invention to provide a process for manufacturing a field emission element which is capable of readily manufacturing a field emission element having the above-described characteristics.

In accordance with one aspect of the present invention, there is provided a field emission element which comprises: a substrate; and an emitter, a collector and a gate arranged on the substrate; the substrate being formed with a recess in proximity to the electrodes on the substrate other than the gate being located in the recess.

In accordance with another aspect of the present invention there is provided a process for manufacturing a field emission element comprising the steps of: depositing a first conductive material on a substrate; working the first conductive material into electrodes including an emitter subjecting the substrate to etching in both the depth direction and in directions parallel to the plane of the substrate while using the worked electrodes forming a second conductive material on the substrate while using the worked electrodes as a mask so that the second conductive material has a film thickness smaller than the depth of etching of the substrate; and working the second conductive material into a gate located between the worked electrodes.

The emitter when viewed from above may be rectangular, serrated with a correspondingly shaped gate or pectinate with rectangular projections at its distal end. There may be two emitters (or more) with the groove between them. A phosphor layer may be applied to the collector.

In accordance with a preferred embodiment of the present invention, a process for manufacturing a field emission element comprises the steps of depositing a first conductive material on a substrate, working the first conductive material into emitters of an approximate configuration or a combination of an emitter of an approximate configuration and a collector, subjecting the substrate to etching in both the depth direction and the plane direction while using the emitters or the combination of the emitter and collector as a mask, forming a second conductive material on the substrate while using the emitters or the combination of the emitter and collector as a mask so that the second conductive material has a film thickness smaller than the depth of etching of the substrate, precisely working the emitters formed of the first conductive material into an approximate configuration into a desired configuration and working the second conductive material into a gate arranged between the emitters or between the emitter and collector of the combination.

In the present invention, constructed as described above, the interval between the emitter or collector formed on the substrate and the gate arranged in the recess formed in the substrate along the emitter and collector can be minutely controlled by adjusting the thickness of the gate in the direction of depth the recess. Also, formation of the emitter into a rectangular or pectinate shape permits the electric field strength to be increased compared with an emitter in the shape of a flat plate and to exhibit satisfactory reproducibility, stability and an increased lifetime as compared with an emitter provided with an acute projection.

BRIEF DESCRIPTION OF THE DRAWINGS

The invention may be carried into practice in various ways and some embodiments will now be described by way of example with reference to the accompanying drawings in which.

DETAILED DESCRIPTION OF THE PREFERRED EMBODIMENTS

Figure 1A:
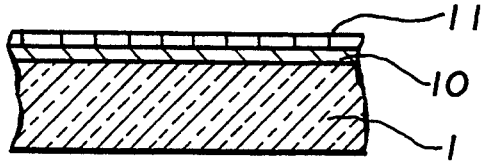
FIG. 1(*a*) to 1(*f*) are schematic sectional views showing successive steps in the manufacture of a first embodiment of a field emission element according to the present invention.
Figure 1B:
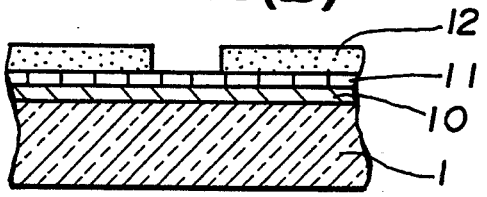
Figure 1C:
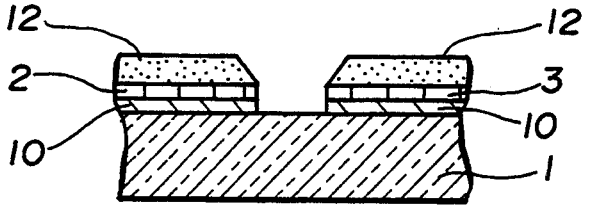
Figure 1D:
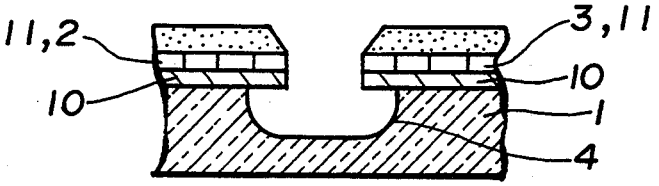
Figure 1E:
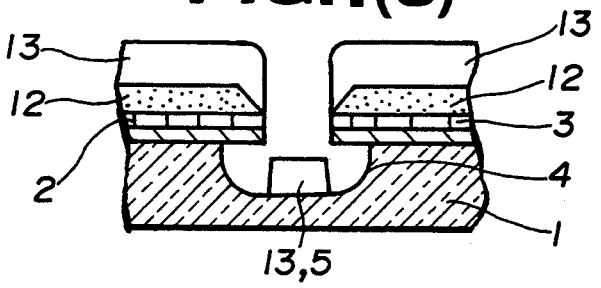
Figure 1F:
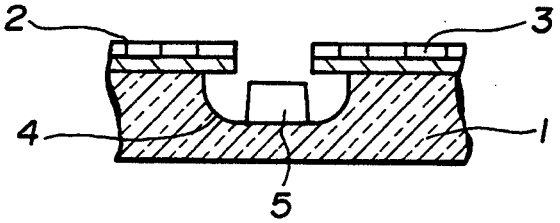
Figure 2:
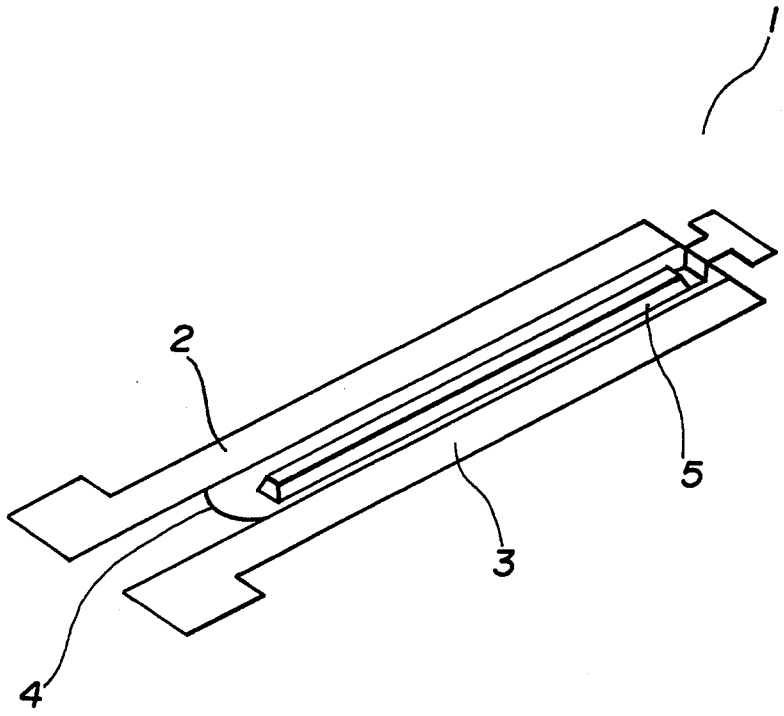
FIG. 2 is a perspective view of the field emission element shown in FIGS. 1(*a*) to 1(*f*)

FIGS. 1 and 2 illustrate a first embodiment of a field emission element according to the present invention. The field emission element includes an insulating substrate 1 made of an insulating material such as glass, quartz or the like, and an emitter 2 and a collector 3 which are arranged at predetermined intervals on the substrate 1. Between the emitter 2 and the collector 3, the substrate 1 is formed with a groove 4 which acts as a recess. The groove 4 is provided at the bottom with a gate 5 which has a thickness somewhat smaller than the depth of the groove 4. Such a construction of the field emission element in which the emitter 2 and collector 3 are arranged on the substrate 1 and the gate 5 is formed on the bottom of the groove 4 permits the thickness of the gate 5 to be adjusted by an amount of the order of sub-microns, so that the interval between the emitter 2 and the gate 5 or that between the collector 3 and gate 5 may be minutely set or determined. Thus, it will be noted that the field emission element of the illustrated embodiment permits the interval to be significantly reduced as compared with that defined by the photolithography techniques conventionally used.

A method of manufacturing a triode element, which is one example of the field emission element of the illustrated embodiment, will be described with reference to FIGS. 1(*a*) to 1(*f*).

Firstly, as shown in FIG. 1(*a*), a thin film 10 of a material such as Al, Nb or the like which exhibits good adhesion to the substrate 1 and is formed on the substrate, and then an electrode layer 11 of W or the like is arranged on the film 10.

Then, as shown in FIG. 1(*b*), a resist layer 12 is provided on the electrode layer 11 and is subjected to etching in a predetermined pattern by exposure, so that the pattern of an electrode configuration may be formed.

Subsequently, RIE dry etching techniques are carried out using SF6 or CF4 gas, with the result that the etching is effected to a distance or depth extending to the upper surface of the substrate 1, as shown in FIG. 1(*c*). This causes the electrode layer 11 to be worked or separated into an emitter 2 and a collector 3 with a predetermined interval defined between them.

Thereafter, as shown in FIG. 1(*d*), the substrate 1 is subjected to etching using HF, BHF or the like, so that a groove 4 of about 1 um in depth is formed in the substrate 1 in the region between the emitter 2 and the collector 3. In this step, side etching in the plane of the substrate is carried out with respect to the substrate 1.

Then, as shown in FIG. 1(*e*), metal 5 for a gate electrode is deposited on the groove 4 of the substrate 1 to form a gate 5 of the desired pattern on the bottom of the groove 4. The gate 5 is formed to a thickness smaller than the depth of etching of the substrate 1 or the depth of the groove 4. For example, it may be formed into a depth of 0.9 um. the deposition or formation of the gate 5 is carried out in such a manner that the upper end of the gate 5 is prevented from extending to or touching the emitter 2 and the collector 3. The interval between the gate 5 and the emitter 2, and that between the gate 5 and the collector 3 are set depending upon the thickness of the gate 5. The thickness of the gate 5 may be controlled by varying the period of time during which deposition of the gate 5 takes place, so that the control may be accomplished very accurately permitting the gate to be formed minutely to a thickness of the order of sub microns. Thus, the present invention permits the interval between the electrodes to be minutely or microscopically set or determined with great accuracy as compared with a conventional field emission element in which the electrodes are arranged side by side on the same plane.

Finally, as shown in FIG. 1(*f*), the resist layer 12 and the metal 13 on the resist layer 12 are removed, resulting in a field emission element of the triode tube structure being obtained.

Figure 3:
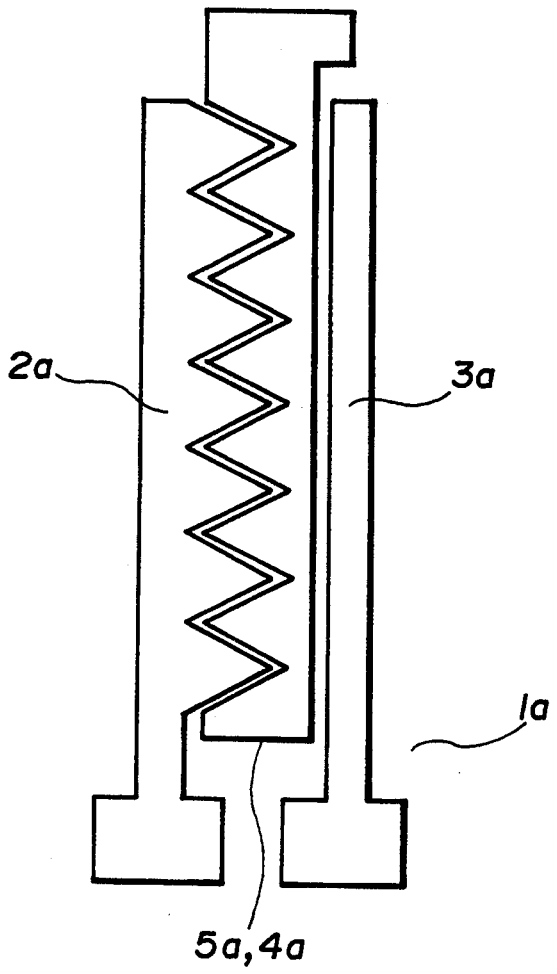
FIG. 3 is a plan view showing another embodiment of a field emission element according to the present invention.

FIG. 3 shows the electrode a pattern of a second embodiment of a field emission device according to the present invention. An emitter 2*a* and a collector 3*a* each are arranged on a substrate 1*a* and a gate 5*a* is provided in a groove 4*a* formed on the substrate 1*a* between the emitter 2*a* and the collector 3*a*, as in the first embodiment described above. The emitter 2*a* includes an electron emission section formed into a serrated shape. The groove 4*a* and gate 5*a* are formed into a similar serrated shape so as to correspond to the emitter 2*a* in a nested manner. The remaining part of the second embodiment is constructed in substantially the same manner as the first embodiment described above.

Both the first and second embodiments are directed to a field emission element of the triode tube structure. In each embodiment, the arrangement or deposition of a phosphor on the collector 3 or 3*a* allows the field emission element to serve as a fluorescent display device ring electrons impinging on the collector 3 or 3*a* excite the phosphor to cause it to emit light. In this instance, a suitable selective setting of the configuration of the collector or the pattern or deposition of the phosphor will permit any desired characters, figures or the like to be luminously displayed.

Also, both these embodiments may be so constructed that two such emitters are arranged on the substrate, the groove is formed in that part of the substrate between the emitters, and an anode functioning as the collector and a phosphor are provided above the substrate. Such a construction similarly allows the field emission element to serve as a display device.

Figure 4:
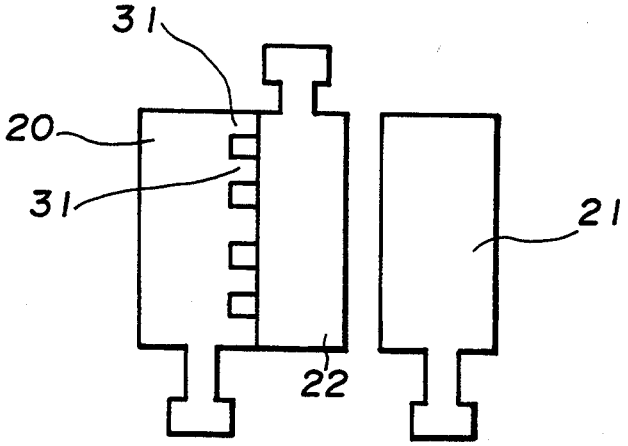
FIG. 4 is a plan view showing a third embodiment of a field emission element according to the present invention.

A third embodiment of a field emission element according to the present invention will be described with reference to FIGS. 4 to 13(*b*). As shown in FIG. 4, an emitter 20 and a collector 21 are arranged on a substrate and a gate 22 is provided in a recess formed in the substrate between the emitter 20 and the collector 21, as in the first and second embodiments. The emitter 20 is formed with a pectinate shape when viewed from the above, that is to say, it has rectangular projections 31. Such a configuration permits the electric field to be concentrated at each of the rectangular projections 31, with the result that the emitter 20 exhibits an increased electric field strength as compared with an emitter in the form of a flat plate. Also, the distal end of each of the rectangular projections 31 is linear, so that the emitter 31 may exhibit an extended lifetime as compared with the emitter of FIG. 3 which has a triangular shape. The emitter may be made of a metal such as Mo, W or the like. Alternatively, it may comprise a composite including a base made of a metal such as Ti, Al or the like and a film made of a compound semiconductor material such as LaB6 or the like deposited on the base.

The way in which the rectangular emitter 20 formed into a pectinate shape is manufactured will be described with reference to FIGS. 5 to 13(*b*).

Figure 5:
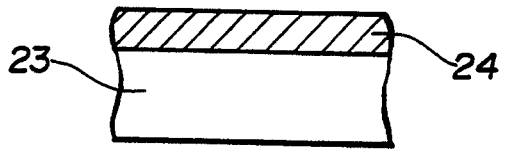
FIGS. 5, 6(*a*) and 6(*b*), 7, 8, 9, 10(*a*) and 10(*b*), 11(*a*) and 11(*b*), 12(*a*) and 12(*b*), and 13(*a*) and 13(*b*) are schematic sectional views showing successive steps in the manufacture of the field emission shown in FIG. 4.
Figure 6A:
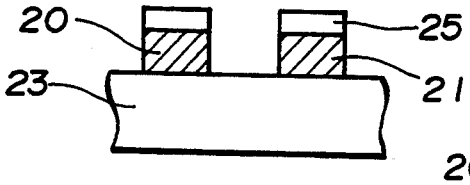
Figure 6B:
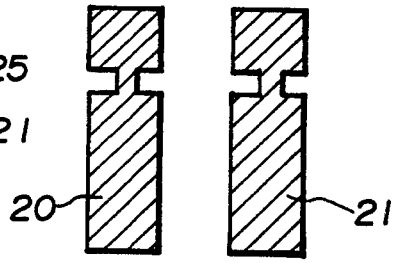

As shown in FIG. 5, a metal layer 24, which is a first conductive material, is formed on an insulating substrate 23. Then, as shown in FIG. 6(*a*), a resist 25 if formed in a predetermined pattern on the metal layer 24, which is then subjected to etching, thereby forming the emitter 20 and collector 21 as shown in FIG. 6(*b*).

Figure 7:
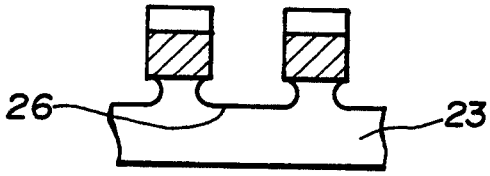

Subsequently, the substrate 23 is subjected to etching in both the depth direction and the plane direction while using the emitter 20 and collector 21 as a mask, thereby forming a recess 26 on the substrate 23, as shown in FIG. 7.

Figure 8:
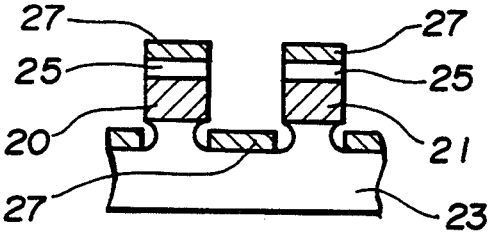
Figure 9:
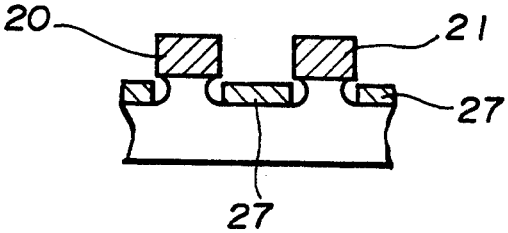

Then, as shown in FIG. 8, a gate metal layer 27 acting as a second conductive material is formed on the etched surface of the substrate 23 by vacuum deposition so as to have thickness which is smaller than the depth of etching of the substrate 23. As shown in FIG. 9, the resist 25 and the unwanted portion of the gate metal layer 27 on the resist 25 are removed.

Figure 10A:
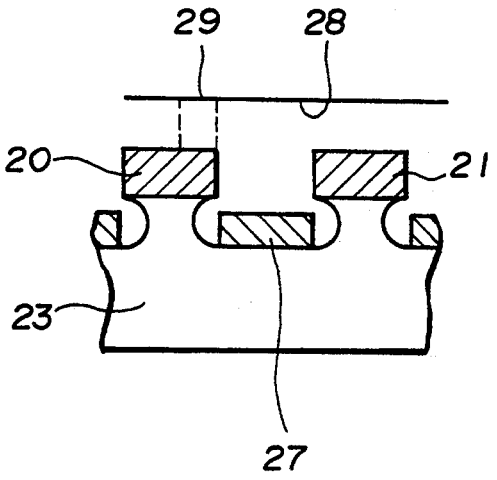
Figure 10B:
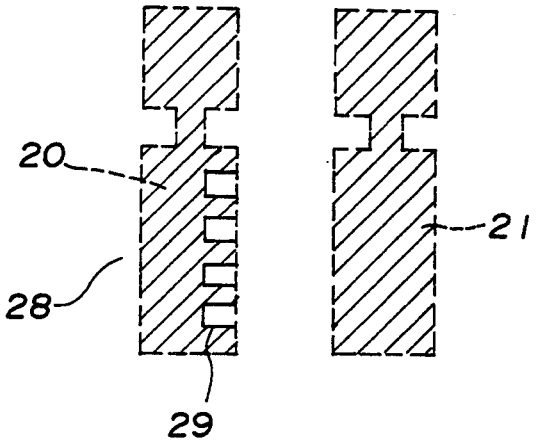

Thereafter, as shown in FIGS. 10(*a*) and 10(*b*), a resist 28 is coated all over the entire substrate 23 and that portion of the resist 28 at the side edge portion of the emitter 20 which faces the collector 21 is formed with a plurality of rectangular window-like apertures 29 through etching by exposure. In each of the first and second embodiments described above with reference to FIGS. 1 to 3, the emitter is initially formed into a predetermined pattern. However, the present invention permits the emitter to be formed into a predetermined pattern at any stage subsequent to the deposition on the substrate, for example in the embodiment shown in FIGS. 5 to 13(*b*).

Figure 11A:
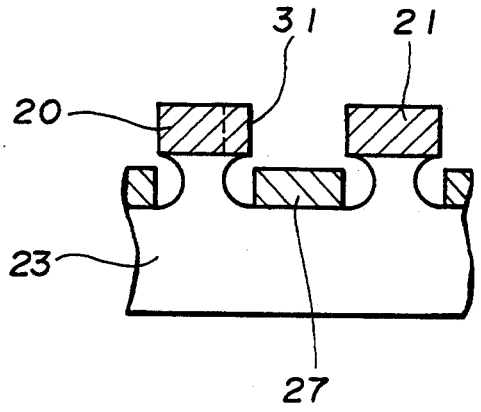
Figure 11B:
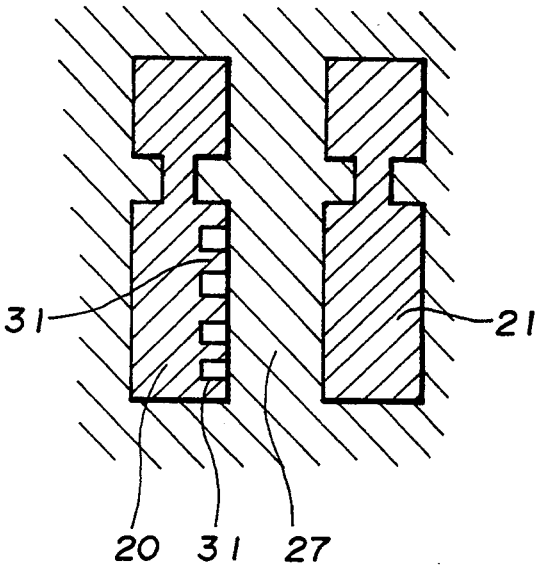

Then, as shown in FIGS. 11(*a*) and 11(*b*), only the side edge portion of the emitter 20 facing the collector 21 is subject to etching, through the rectangular apertures 29 formed at the resist 28, so that the emitter 20 is formed into a pectinate shape, resulting in its being provided with the rectangular projections 31.

Figure 12A:
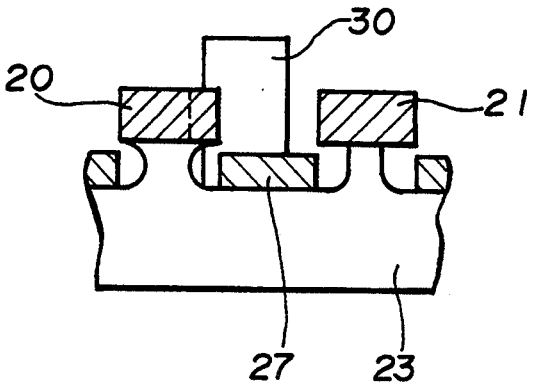
Figure 12B:
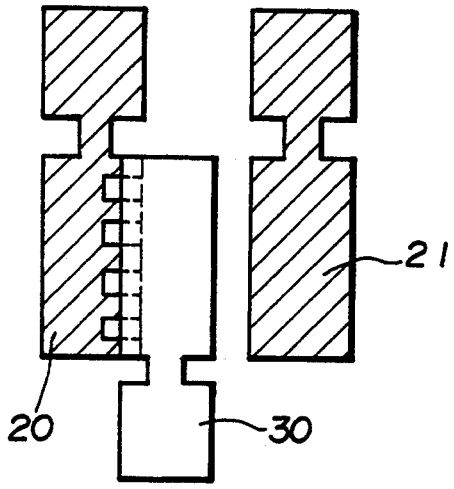

Next shown in FIGS. 12(*a*) and 12(*b*), a resist 30 is coated in such a way that it overlaps somewhat a part of the side edge portion of the emitter 20 which is opposite to the collector 21, thereby forming a gate pattern. This overlapping of the gate pattern with the emitter 20 from being exposed to etching.

Figure 13A:
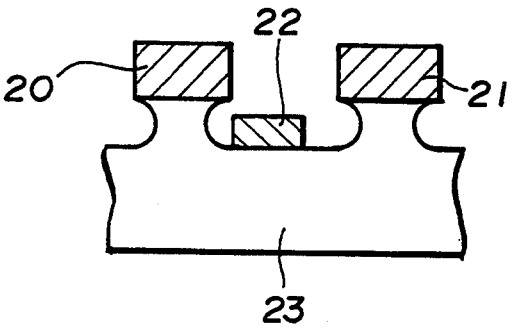
Figure 13B:
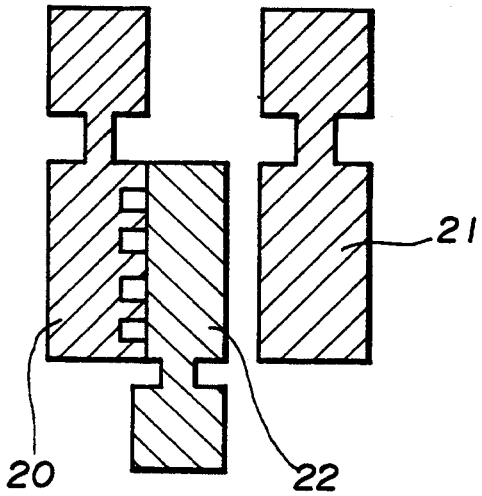
Figure 14:
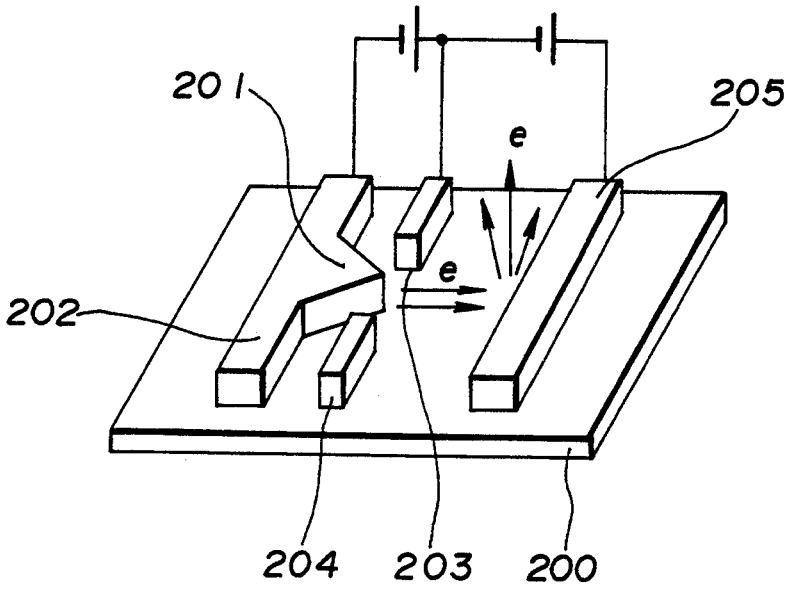
FIG.14 PRIOR ART
FIG. 14 is a schematic perspective view showing one example of a conventional field emission element.

Thereafter, as shown in FIG. 13(*a*) and 13(*b*), etching is carried out while keeping the resist 30 at the gate pattern formed in the preceding step, thereby forming the gate 22 in the desired pattern. The resist 30 is then removed.

In the manufacturing process described above, the metal layer acting as the first conductive material which forms the emitter 20 and collector 21 is deposited or formed as a single-ply structure. However, it may be formed of a plurality of material as a multi-ply structure as required. The gate metal layer 27 acting as the second conductive material forming the gate 22 likewise may be formed of a plurality of materials into a multi-ply structure. Also, all the embodiments described with respect to a triode tube structure, however, the present invention may equally be applied to a multi-electrode tube having one or more additional electrodes incorporated therein, in order to improve its characteristics.

As can be seen from the foregoing, the present invention is so constructed that the gate is arranged in a recess formed in the substrate in proximity to the electrodes arranged on the substrate. Such a construction permits the present invention to exhibit the following advantages:

Firstly, the interval between the emitter and the gate can be minutely controlled depending upon the thickness of the thin film forming each of the electrodes rather than being dependent upon the accuracy of working by etching by exposure, and can therefore be readily controlled in increments of the order to submicrons. Thus, the interval can be minutely set of determined to a degree sufficient to lower significantly the voltage at which field emission is initiated.

Also, when the present invention is constructed into a triode tube structure in which the emitter and collector are arranged substantially opposite to each other, the above-described construction permits the interval between the emitter and the collector to be reduced, so that mutual conductance may be increased to improve the high-frequency characteristics.

Furthermore, it is possible to provide a self aligning structure in which the positioning of the emitter and collector permits the gate to accurately positioned, and so the field emission element of the present invention can be manufactured to a high degree of accuracy, readily increased in areas and in large quantities with ensured uniformity.

In addition, a conventional field emission element of a Spindt structure in which the emitter is conical and the gate is a round hole suffers the disadvantage that the field emission is non-uniform due to a fine variation in configuration at the distal end of the emitter. However, the construction of the present invention effectively eliminates this disadvantage.

Furthermore, formation of the emitter into a stripe-like shape permits the field emission element to have an increased electron emission area, resulting in an improved current density.

Moreover, formation of the emitter into a rectangular shape or a pectinate shape, which allow the emitter to be provided with rectangular projections, permits the electric field strength to be increased as compared with an emitter in the form of a flat plate. Also, this permits the emitter to enjoy an extended life as compared with an emitter which includes an electron emission section formed in an acute shape.

We claim:

1. A field emission element comprising:

an insulating substrate having a planar surface and a recess;

an emitter and a collector formed on said planar surface in a coplanar configuration and spaced apart by said recess; and a gate formed on said recess between said emitter and said collector;

wherein said emitter has a pectinate shape when viewed from above including rectangular projections of a predetermined pitch at a distal end and wherein said rectangular projections have edges which lie substantially on a same plane with an edge of said gate and wherein said gate is formed entirely below said planar surface.

2. The field emission element as defined in claim 1, wherein said gate has a thickness thinner than the depth of said recess.

3. The field emission element as defined in claim 1, wherein said emitter is made of Mo.

4. The field emission element as defined in claim 1, wherein said emitter is made of W.

5. The field emission element as defined in claim 1, wherein said emitter is made of a compound semiconductor which is deposited on a metal base.

6. The field emission element as defined in claim 5, wherein said compound semiconductor is $LaB_6$.

* * * * *